United States Patent [19]

Schonwald et al.

[11] 3,982,848

[45] Sept. 28, 1976

[54] SIDE CHANNEL RING COMPRESSOR INCLUDING A CHANNEL BREAK DECOMPRESSION NOZZLE

[75] Inventors: Siegfried Schonwald, Bad Neustadt; Peter Obert, Ulm, both of Germany

[73] Assignee: Siemens Aktiengesellschaft, Munich, Germany

[22] Filed: Feb. 25, 1975

[21] Appl. No.: 552,938

[30] Foreign Application Priority Data

Feb. 26, 1974 Germany ..... 2409183

[52] U.S. Cl. ..... 415/53 T; 415/213 T

[51] Int. Cl.[2] ..... F04D 5/00

[58] Field of Search ..... 415/53 T, 213 T

[56] References Cited

UNITED STATES PATENTS

| | | | |
|---|---|---|---|
| 2,210,141 | 8/1940 | Cornell, Jr. | 415/213 T |
| 2,364,168 | 12/1944 | Shallenberg | 415/213 T |
| 3,560,104 | 2/1971 | Neale | 415/213 T |

FOREIGN PATENTS OR APPLICATIONS

| | | | |
|---|---|---|---|
| 501,663 | 7/1930 | Germany | 415/213 T |
| 902,074 | 1/1954 | Germany | 415/213 T |
| 225,631 | 5/1943 | Switzerland | 415/213 T |

*Primary Examiner*—C. J. Husar

*Attorney, Agent, or Firm*—Kenyon & Kenyon Reilly Carr & Chapin

[57] ABSTRACT

A side-channel ring compressor including an impeller having radially outwardly extending blades, compressor medium inlet and outlet openings communicative with the side-channel thereof, and a channel break disposed between the inlet and outlet openings. At least one decompression nozzle is disposed in the channel break between the compressor medium inlet and outlet openings, and has an opening which is communicative with the side channel for exhausting compressed gas from between the impeller blades in the channel break and directing the exhausted gas into the side channel of the compressor.

3 Claims, 3 Drawing Figures

SIDE CHANNEL RING COMPRESSOR INCLUDING A CHANNEL BREAK DECOMPRESSION NOZZLE

BACKGROUND OF THE INVENTION

1. Field of The Invention

This invention relates generally to side-channel ring compressors, and in particular to an improved side channel construction for such ring compressors by means of which compressed gas is exhausted from between the impeller blades of the compressor as it passes through the side-channel break thereof, and is subsequently directed into the side-channel either adjacent or against the compressor impeller blades.

2. Description of the Prior Art

Generally speaking, in side-channel ring compressors in which compression ratios greater than 1.2 are produced, the compressed fluid medium disposed between the blades of the compressor impeller is moved past the outlet opening of the side-channel and through the compressor break disposed between the channel inlet and outlet openings. This compressed gas expands into the side channel as it reaches the suction side thereof at the compressor medium inlet opening, and thereby restricts the flow of compressor medium into the side channel. As a result, both the efficiency of the compressor and the pressure ratio attainable therein are significantly reduced.

SUMMARY OF THE INVENTION

It is therefore an object of the present invention to provide an improved side-channel ring compressor construction and to overcome the aforementioned disadvantages of heretofore known side-channel ring compressors by using the energy of the compressed gas trapped between the compressor impeller blades and moved into the channel break.

These and other objects of the invention are achieved in a side-channel ring compressor which includes an impeller having radially outwardly extending blades, compressor medium inlet and outlet openings communicative with the side channel of the compressor, and a channel break disposed between the inlet and outlet openings. The improvement of the invention comprises the provision of at least one decompression nozzle disposed in the side-channel break between the compressor medium inlet and outlet openings having an opening which is communicative with the side-channel. This decompression nozzle permits the expansion of compressed gas trapped within the channel break between the impeller blades of the compressor to expand, and exhausts this gas from the channel break in the form of a high velocity gas jet which is directed into the side channel either adjacent or into the compressor impeller blades.

These and other novel features of the invention will be described in greater detail in the following detailed description.

DETAILED DESCRIPTION

Figure 1:
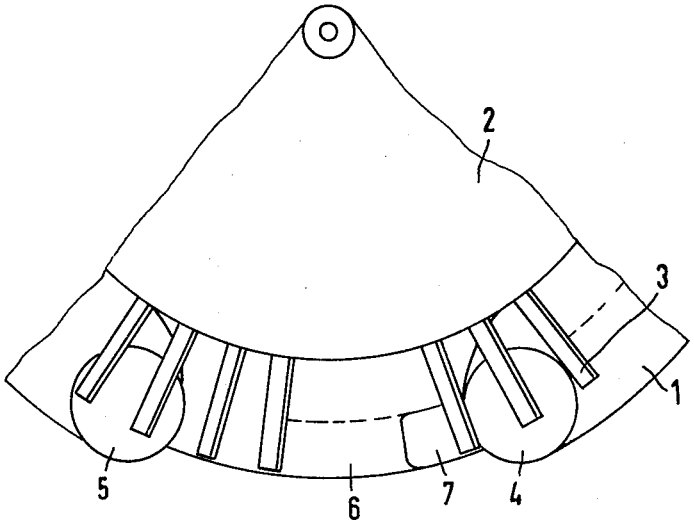
FIG. 1 is a partial, schematic side view of a side-channel compressor constructed according to the invention.

Referring now to the drawings, and in particular to FIG. 1, there is shown a side-channel ring compressor including a side channel 1 and a compressor impeller 2 having radially outwardly extending blades 3 disposed thereon. The compressor also includes a compressor medium inlet opening 4 and a compressor medium outlet opening 5 both of which are communicative with side channel 1. A channel break 6 is disposed between openings 4 and 5 and is also communicative with side channel 1. At least one pocket-like, decompression nozzle 7 is disposed in channel break 6 between openings 4 and 5 is communicative therewith for exhausting compressed gases from the channel break. The nozzle also has an opening which opens into side channel 1 near inlet opening 4 and adjacent one side of impeller 2.

Figure 2:
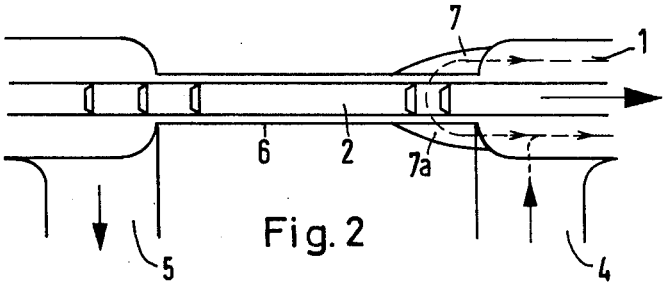
FIG. 2 is a partial, schematic plan view of another embodiment of a side-channel ring compressor constructed according to the invention.

As shown in FIG. 2, the opening of nozzle 7 directs the exhausted gas into side channel 1 on one side of impeller blades 3. The nozzle may also be constructed so that the nozzle opening opens into side channel 1 directly adjacent inlet opening 4 on the other side of the impeller blades as shown by nozzle 7*a*.

Figure 3:
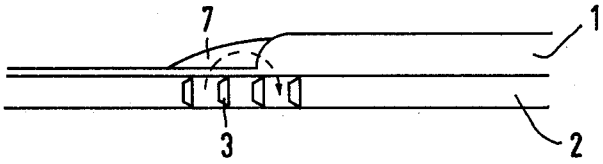
FIG. 3 is a partial, schematic plan view of a further embodiment of a side-channel ring compressor constructed according to the invention.

The nozzle may additionally be provided with a curved configuration as illustrated in FIG. 3, and be directed inwardly towards the impeller blades so as to direct exhausted gases into impeller blades 3 in side channel 1.

In operation, the compressor medium is drawn into side channel 1 through inlet opening 4 and is compressed by impeller 2 as it is rotated therein. Most of the compressed gas is then exhausted through outlet opening 5. Some of the compressed gas, however, is trapped between blades 3 of impeller 2 and is therefore moved into and through channel break 6. This compressed gas is permitted to expand and is exhausted from channel break 6 through the decompression nozzle which directs the gas into side channel 1 through the nozzle opening. Where the gas is directed straight into side channel 1, as is the case when nozzle 7 is utilized, the volume of gas drawn into side channel 1 is increased and precompressed. Where the gas is directed into the side channel adjacent inlet opening 4, as by nozzle 7*a*, the medium entering side channel 1 through opening 4 is sucked into the side channel and is mixed with the jet of gas entering the channel through the nozzle opening. The intake of compressor medium through opening 4 is thereby accelerated. Finally, where the exhausted gas is directed into the impeller blades, as in the embodiment of FIG. 3, the drive torque required to rotate the impeller is reduced. All three of the improvements of the invention thus increase the efficiency of the compressor.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than in a restrictive sense.

What is claimed is:

1. In a side-channel ring compressor including an impeller having radially outwardly extending blades, compressor medium inlet and outlet openings communicative with the side channel of said compressor, and a channel break disposed between said inlet and outlet openings, the improvement comprising at least one pocket-like decompression nozzle disposed in said side channel break between said compressor medium inlet and outlet openings and opening directly into said side channel on one of the sides thereof near said compressor medium inlet opening for exhausting compressed compressor medium from between said impeller blades in said channel break and directing said exhausted medium into said side channel adjacent said impeller.

2. The side-channel ring compressor recited in claim 1, wherein said nozzle opening opens into said side channel on one side of said impeller adjacent said compressor medium inlet opening.

3. The side-channel ring compressor recited in claim 1, wherein said nozzle has a curved configuration and is directed towards said impeller for directing said exhausted compressor medium into said impeller blades in said side channel.

* * * * *